United States Patent [19]

Hascall

[11] 4,007,569

[45] Feb. 15, 1977

[54] METHOD AND MEANS FOR SEALING DOOR EDGES

[76] Inventor: Norman E. Hascall, 1035 E. State Street, Geneva, Ill. 60134

[22] Filed: Feb. 2, 1976

[21] Appl. No.: 654,167

[52] U.S. Cl. ..... 52/309.3; 49/501; 52/624

[51] Int. Cl.[2] ..... E04C 2/20

[58] Field of Search ..... 52/614, 615, 624, 309; 49/501; 428/45, 81, 192, 321, 63

[56] References Cited

UNITED STATES PATENTS

| | | | |
|---|---|---|---|
| 1,489,170 | 4/1924 | Stutz | 52/455 |
| 2,003,712 | 6/1935 | Hacker | 52/624 X |
| 2,821,497 | 1/1958 | Works et al. | 52/624 |
| 3,720,027 | 3/1973 | Sondergaard | 52/624 X |

FOREIGN PATENTS OR APPLICATIONS

| | | | |
|---|---|---|---|
| 1,121,309 | 1/1962 | Germany | 52/614 |

*Primary Examiner*—Alfred C. Perham
*Attorney, Agent, or Firm*—Hill, Gross, Simpson, Van Santen, Steadman, Chiara & Simpson

[57] ABSTRACT

The absorption of moisture by the unfinished edge of an exterior wooden door, particularly through the bottom edge, is prevented by overlaying a sheet-form or tape bridging member over the edge of the door and bonding the member by an adhesive to such edge to form a moisture impervious bridging sealing layer.

4 Claims, 6 Drawing Figures

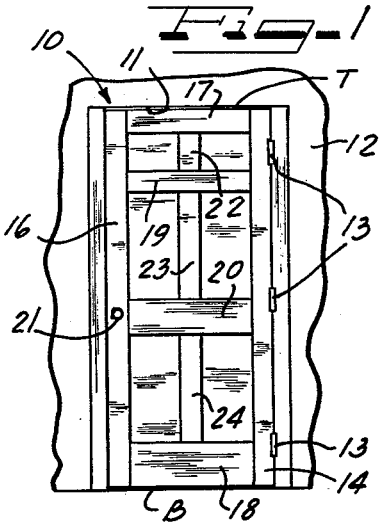
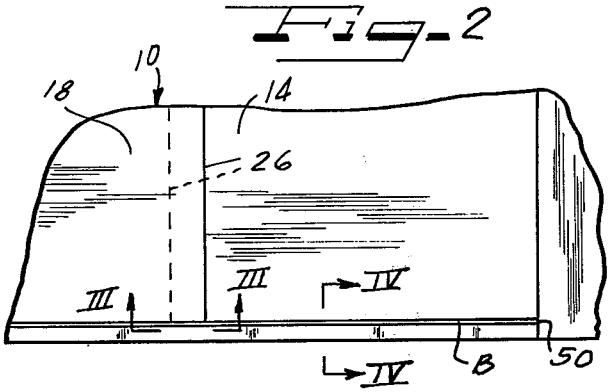
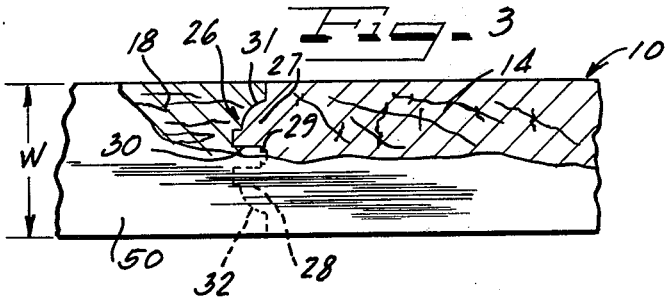
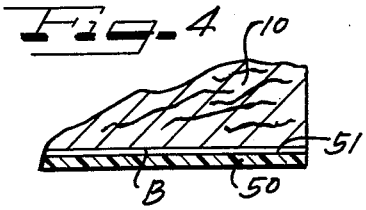
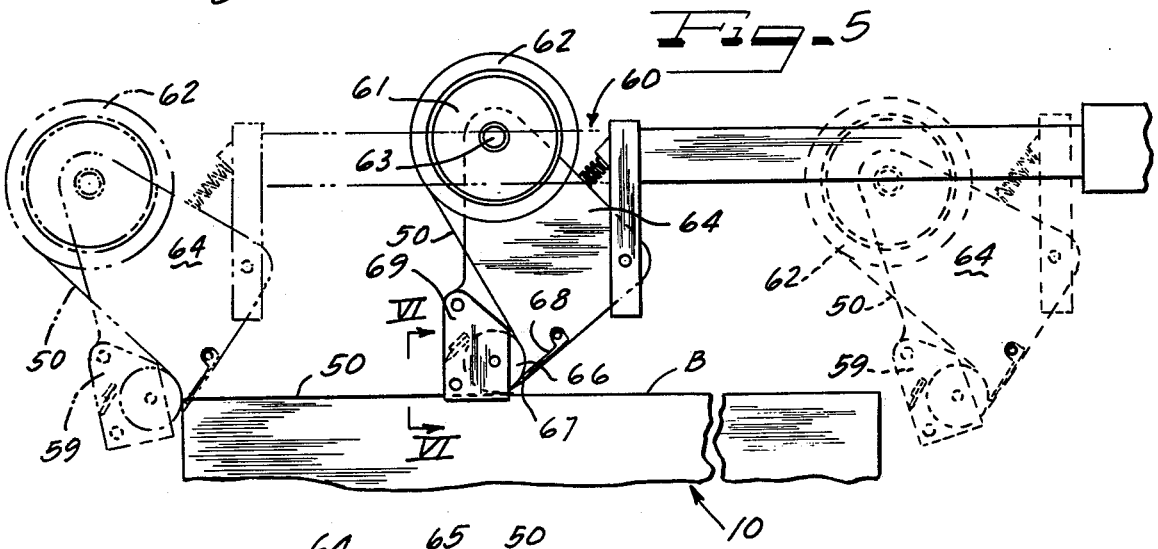
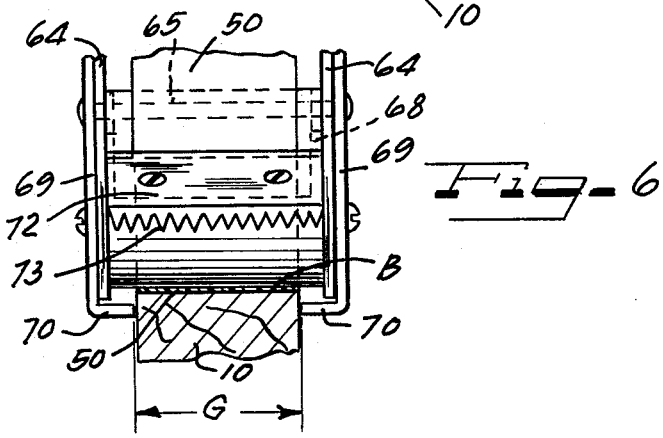
Fig-6

METHOD AND MEANS FOR SEALING DOOR EDGES

BACKGROUND OF THE INVENTION

1. Field of the Invention

This invention relates generally to a method and means of sealing door edges and more specifically relates to a method and means of sealing the edges of wooden doors.

2. Description of the Prior Art

Absorption of moisture by unfinished edges of exterior doors, particularly through the bottom edge, causes many problems such as excess expansion, warpage, stile-rail separation and delamination.

In an effort to cope with the problem, the National Woodwork Manufacturers Association and the Fir and Hemlock Door Association require in their standard door guarantee that doors should be delivered to a job site only after the plaster or the cement is dry and if the doors are to be stored at the job site for more than a week, than at least the top and bottom edges of the doors must be sealed with a resin or pigmented base sealer.

Further, such guarantee requires that immediately after fitting, beveling, and cutting for closers and before hanging, ". . . the entire door, including the top and bottom edges, must receive two coats of paint, varnish, or equal sealer to prevent undue absorption of moisture." The guarantee further requires that adequate drying time must be allowed between coats.

Current construction practices make difficult full compliance with the guarantee requirements particularly as concerns the bottom edge of the door. After a door is hung, it must be taken down to seal the bottom edge and the two-coat procedure with intervening drying times is regularly by-passed by most builders.

Even when correctly applied, the application of a liquid coating such as paint or a sealer or a liquid resin is inadequate to cope with the problem because the joints at the sticking between the stiles and the rails expand and form leakage joints along which moisture passes and enters the interior portions of the door.

SUMMARY OF THE INVENTION

By the present invention, the door edges are sealed by overlaying a thin, sheet-form backing sheet or tape over the edge to completely bridge the entire edge surface with a continuous, unbroken, moisture impervious sealing layer.

The sheet or tape is bonded to the door edge by a bonding agent such as an adhesive to integrate the sheet and the door edge in a sealing-bridging relation. Thus, even possible expansion between the stiles and rails does not impair the integrity of the seal, since all joints intersecting the door edge are completely bridged.

The backing sheet or tape is provided in accordance with prescribed standards determined in accordance with the present invention as to moisture permeability, adhesion, tensile strength, abrasion resistance and temperature range effectiveness.

The sheet or tape can be applied at the factory as a fabricating step, thereby forming a mechanical sealing barrier on the door edges, or alternately, the sheet or tape can be applied in the field to doors which are destined for delivery to a job site at any time before or after hanging the door.

BRIEF DESCRIPTION OF THE DRAWING

FIG. 1 is an elevational view of a typical wooden stile and rail door embodying the improved features of the present invention.

FIG. 2 is a fragmentary enlarged view of a portion of the bottom edge of the door of FIG. 1.

FIG. 3 is a fragmentary cross-sectional view taken on line III—III of FIG. 2 with parts removed to show additional details of construction.

FIG. 4 is a fragmentary view taken on line IV—IV of FIG. 2.

FIG. 5 is a view showing an apparatus for applying the sealing means to the door edge either manually or automatically as a part of a fabricating procedure.

FIG. 6 is a fragmentary view taken on line VI—VI of FIG. 5 showing additional details of the application apparatus.

DESCRIPTION OF THE PREFERRED EMBODIMENTS

The principles of the present invention are of general applicability to any door construction having problems arising due to undue absorption of moisture. By way of exemplification of the principles of the present invention, there is shown generally at 10 in FIG. 1 a so-called wooden stile and rail door which is used to close an opening 11 in an architectural structure 12. The door is hung by means of hinges 13 attached to a stile 14 extending vertically along one edge of the door 10. A stile 16 is located at the opposite edge of the door and between the stiles 14 and 16 there extends a top rail 17 and a bottom rail 18 as well as an intermediate rail 19 and a so-called lock rail 20. A typical door lock 21 is carried opposite the lock rail 20 in the stile 16 and may cooperate with mating portions of a lock mechanism carried in the adjoining frame of the opening 11. Extending between the rails are mullions shown from top to bottom at 22, 23 and 24.

As is customary in the door industry, there is provided between the rails and the stiles a complementary interfitting male and female lock joint which is formed by a sticking shown in the cross-section of FIG. 3 at 26. As a matter of fact, many manufacturers use distinctive sticking between the stiles and the top and bottom rails to clearly identify doors originating with the particular manufacturer. By looking at the top or bottom end of a door, a shaped tip entering a somewhat correspondingly shaped notch can be seen in section, which interfit frequently forms a moisture carrying passage extending into the door. In any event, as shown in FIG. 3, the sticking 26 in this particular illustration of the inventive subject matter is formed between a stile 14 and the bottom rail 18 and constitutes an outwardly projecting portion 27 formed on the stile and spaced from a correspondingly shaped outwardly projecting portion 28, the two projecting portions being separated by a medially disposed recess 29.

The adjoining portion of the bottom rail 18 is complementarily shaped to provide a tenon 30 which enters the corresponding recess 29 and correspondingly shaped recess portions 31 and 32 mate with the corresponding projecting portions 27 and 28, thereby to form the sticking 26.

It has been determined that the sticking 26 constitutes a joint which intersects the corresponding bottom and top edges of the doors and actually forms a path or passage along which moisture may travel to the interior portions of the door. For purposes of identification, the bottom edge of the door 10 is indicated herein by the legend B and the top edge is indicated by the legend T.

In accordance with the principles of the present invention, it is contemplated that the absorption of moisture into the door along either the top or bottom edges T and B and particularly the bottom edge will be prevented by overlaying a thin, continuous moisture impervious sheet-form member to completely cover the door edges T and B and to bridge the matched joints which may intersect the edges such as the sticking at 26 as well to completely cover the entire moisture absorptive edge of the door to prevent leakage of moisture into the stiles, the rails and the joints.

In this connection, such a sheet-form member is shown in the drawings in somewhat enlarged, exaggerated form so that the structural and functional characteristics thereof may be clearly identified. Referring to FIGS. 2, 3, and 4, it will be noted that the sheet-form member constitutes a vinyl backing sheet or tape shown at 50. Ideally, the sheet-form member 50 may be made in a configuration to be of a width corresponding to the width of the door, which width is indicated at W in FIG. 3. In selecting a sheet-form member or tape, I have discovered that the sheet-form member must display requisite characteristics of performance including moisture permeability, adhesion, tensile strength, abrasion resistance and temperature range effectiveness within satisfactory levels. For example, good performance is obtained by using a vinyl plastic tape which is generally of the type to meet federal specifications PPP-T-66d Amendment 1, Type 1, Class 1 (transparent), Class 2 (colored). The sheet-form member or tape 50 should have moisture permeability measured in terms of water vapor transfer rate in the order of about 2.0 gr. $H_2O$/100 square inches/24 hours.

In terms of tensile strength, the sheet-form member or tape 50 should display minimum tensile characteristics in the order of at least about 10 lb./in. width.

In connection with abrasion resistance, the sheet-form member or tape 50 should display abrasion characteristics similar to the heavy abrasion resistance of floor coverings.

In connection with temperature range effectiveness, the tape should be effective within a temperature range of from about −30° F. to +120° F. [−34° C. to +49° C.].

It is further contemplated in accordance with the principles of the present invention that the vinyl plastic tape 50 will be integrally bonded and adhered to the adjoining edge of the door. Thus, the entire vinyl tape 50 may be coated on one side with a suitable adhesive 51. The adhesive 51 can conveniently constitute any adhesive compatible with the vinyl plastic tape 50 and must display minimum adhesion characteristics in the order of at least 20 oz./inch width.

It will be understood that both the layer of adhesive 51 as well as the vinyl plastic tape 50 should be conformable so as to conform to minor irregularities in the shape of the adjoining door edge and must also display expected resistance to solvents and other liquid coatings customarily applied for decoration purposes to doors and adjoining door opening surfaces.

In order to achieve the bonding, a sheet-form or tape 50 with the adhesive 51 thereon may be applied in the form of a part shaped and configured to correspond to the entire area of the corresponding door edge whereupon the tape is applied to the door edge and is pressed into firm engagement and bonded relationship therewith. In so doing, the vinyl plastic tape 50 will completely bridge all of the absorptive surface of the edge covering the entire door edge from side to side and from end to end over the entire width W. Moreover, the tape 50 will completely bridge any leakage paths or openings provided by the joints at the sticking 26.

In applying the tape in accordance with the principles of the present invention, it will be appreciated that such application can be made at the factory in a mass production technique if desired or the tape can also be applied in the field to existing doors. In order to accomplish that objective, there is shown in FIGS. 5 and 6 a typical apparatus which can consist either of a hand held tape applicator shown generally at 60, which applicator could also constitute a production line applicator if mounted in a suitable support bracket adjacent a door conveyor line. Since corresponding parts would perform corresponding functions, only one description need be given.

Specifically, it is contemplated by the present invention that there would be provided a supply roll 61 on which is stored a supply of tape 62 selected to be of a width W for application to the door edge. The supply roll 61 is supported on a journal 63 carried between spaced bsrackets 64. The tape 50 leaves the supply roll and is threaded over a feeder roll shown at 66 through a nip 67 formed between the feeder roll 66 and an adjoining pressure plate 68.

To insure proper alignment with the door and application of the tape 50, the feeder roll 66 is preferably made of a width corresponding to the width of the door 10 and there are provided guide brackets 69, 69 which are flanged as at 70, 70 thereby to form a guide throat shown in FIG. 6 at G.

It will be understood that the pressure plate 68 is pivotally journaled on an appropriate axle 65. A cutting bar is shown at 72 and has a serrated cutting edge 73 so that the tape 50 may be conveniently cut in a length corresponding to the length of the door edge to which the tape is applied.

There has thus been provided in accordance with the principles of the present invention an improved method and means of preventing the absorption of moisture into wooden doors via the door edges. While minor modifications might be suggested by those versed in the art, it should be understood that I wish to embody within the scope of the patent warranted hereon all such modifications as reasonably and properly come within the scope of my contribution to the art.

I claim as my invention,

1. In combination, a wooden stile and rail door having vertical stiles and top and bottom rails forming top and bottom door edges and such door edges normally constituting unfinished moisture-absorptive areas, and including sticking on each stile and on each rail formed in complementary male and female configurations and together with one another forming a matched joint between a corresponding stile and rail which intersects a corresponding top and bottom door edge, which joint is susceptible to expansion and will form a passage or leakage joint along which moisture may travel to the interior of the door, a thin, continuous moisture-impervious sheet-form member for completely covering a door edge and for bridging said matched joint between the corresponding stile and rail to form a barrier blocking the passage or leakage joint and preventing leakage of moisture into the stiles, the rails, and the joints of the door,.

and pressure-sensitive adhesion means between the sheet-form member and the adjoining edge of the door bonding such sheet-form member and said door in sealed-together conforming relation, the material of said sheet-form member comprising a vinyl plastic exhibiting a moisture-permeability measured in terms of a water transfer rate in the order of about 2.0 gr. $H_2O$/100 square inches /24 hours, thereby to seal the absorptive area and to prevent entry of moisture into the door edge, said sheet-form member being further characterized by said material of said sheet-form member having a minimum tensile strength in the order from at least 10 lb./in. width, thereby to withstand expansion so that said sheet-form will continue to bridge and seal the matched joints for the purposes set forth.

2. The invention as defined in claim 1 and further characterized by said sheet-form member exhibiting an abrasion resistance in the order of high abrasion resistant floor coverings.

3. The invention as defined in claim 1 and being further characterized by said bonding agent comprising an adhesive displaying minimum adhesion characteristics in the order of at least 20 oz./inch width.

4. The invention as defined in claim 1 and being further characterized by the backing sheet and the bonding agent having an effective utility in a temperature range of from about −30° F. to +120° F. [−34° C. to +49° C.].

* * * * *